United States Patent [19]

Berman

[11] Patent Number: 4,653,238

[45] Date of Patent: Mar. 31, 1987

[54] CYLINDRICALLY MODULAR ABOVE-GROUND HOUSING UNITS

[76] Inventor: Jack E. Berman, 532 Custer Ave., No. 2, Billings, Mont. 59101

[21] Appl. No.: 869,656

[22] Filed: Jun. 2, 1986

[51] Int. Cl.[4] ..... E04H 1/00; E04B 1/32

[52] U.S. Cl. ..... 52/79.4; 52/86; 52/236.2

[58] Field of Search ..... 52/79.4, 236.2, 236.6, 52/86

[56] References Cited

U.S. PATENT DOCUMENTS

| | | | |
|---|---|---|---|
| 2,372,187 | 3/1945 | Davison | 52/86 |
| 2,801,716 | 8/1957 | Colby | 52/86 X |
| 3,905,167 | 9/1975 | Watkins et al. | 52/79.4 |
| 4,115,962 | 9/1978 | Caisley | 52/79.4 |
| 4,194,328 | 3/1980 | Peirson et al. | 52/86 |
| 4,534,144 | 8/1985 | Gustafsson et al. | 52/86 X |

*Primary Examiner*—J. Karl Bell
*Attorney, Agent, or Firm*—Douglas L. Tschida

[57] ABSTRACT

Modular living space constructed from ten-foot diameter cylindrical continuous pipe stock of predetermined unit lengths. Depending upon the amount of desired total living space, multiple units may be coupled end-to-end via coupling bands and extension members. The interior walls of each unit are of conventional rectilinear design and are supported from a plurality of nailing member containing lengthwise channels attached to the interior periphery of each cylinder. Primary lengthwise channel members are secured at each quadrant and angle channel members are used at each corner. Window sashes mount to drip edge containing sleeves fitted through the interior and exterior walls. End walls are secured to flanged collar members fitted within the cylinder.

12 Claims, 10 Drawing Figures

CYLINDRICALLY MODULAR ABOVE-GROUND HOUSING UNITS

BACKGROUND OF THE INVENTION

The present invention relates to pre-fabricated, low-cost living shelters and, in particular, units usable at remote sites and constructed of ten-foot diameter culvert stock and wherein the interior walls are supported from a plurality of lengthwise channel members having nailer strips attached thereto. Associated collars mounted to the interior of the cylinders secure the end walls thereto and mounting sleeves secure each window in weather-tight relation to the exterior walls.

Over the years numerous efforts have been expended towards developing pre-fabricated, portable living shelters or housing units for human habitation. Instead of conventionally framed housing, and which is either weight or size prohibitive, the goal of such units is to obtain a construction which is easily replicated in a factory setting, without resort to costly jigs or other labor intensive framing detail. It is a further goal that each unit be of a weight and size to accommodate available and oftentimes unorthodox transportation means to remote sites, while still being durable enough to withstand environmental extremes for a wide range of temperature and humidity conditions. It is a still further goal of such efforts to construct such units to be rigid enough to withstand the rigors of the prevailing environment over long periods of time.

Some prior examples of structures of this type, and which are constructed of compound curved sections, can be seen in U.S. Pat. Nos. 3,187,852; 3,468,083; and 3,390,492. A number of other arched or quonset hut type structures can be seen in U.S. Pat. Nos. 2,257,153; 2,358,388; 2,363,259; 2,642,162; 2,789,668; 3,154,888; and 3,505,765. While each of the former structures provide for a somewhat unconventional overall shape, each of the latter constructions generally provide for exterior walls constructed of a plurality of skin segments secured to one another, such that in combination they define an arch-like shelter of varying length. A number of vertically disposed, cylindrical structures can also be seen in U.S. Pat. Nos. 2,406,593; 2,343,764; 922,329; 1,116,244; and 3,768,016.

Still other structures intended for human habitation and of a more horizontally disposed, tubular construction can be seen in U.S. Pat. Nos. 3,716,954; 3,778,528; 2,871,802; 3,118,401; 4,483,273; and 4,534,144 and which also disclose a number of bomb shelter type constructions.

Some perceived advantages of these latter types of structures, even though they are intended for underground use, are that they may be fabricated in controlled environments, to desired sizes and whereby costs may be kept to a minimum. Multiple sections may, in turn, be secured to one another to ultimately obtain a desired overall sized structure. On-site fitting of piece parts is thus avoided, as well as the loss of individual pieces, due to misplacement.

A problem attendant with such structures, however, is that like with all of the previously mentioned structures, the shelter walls are constructed to be curved and which except for the most rudimentary constructions, such as the intended bomb shelters, require a great deal of labor intensive framing detail, not only as to the walls, floors and ceilings, but also as to room partitions, before a usable long term living space can be achieved.

It is therefore a primary object of the present invention to provide pre-fabricated, modular housing units which are adaptable to existing materials and factory construction techniques and to minimize custom framing detail.

It is a further object of the invention to provide housing units which are constructed from available ten foot diameter, continuous length culvert stock.

It is still another object of the invention to accommodate conventional framing techniques, within the culvert stock, while at the same time obtaining necessary raceways for plumbing, electrical and mechanical systems, not to mention insulation space for colder climates.

It is a still further object to produce housing units which accommodate conventional window sashes and doors.

The above objects, advantages and distinctions, as well as the construction of the invention will become more apparent upon reference to the following description thereof with respect to the appended drawings. Before referring thereto however, it is to be appreciated that the following description is illustrative only of the presently preferred embodiment and should not be interpreted in any way to be self-limiting.

SUMMARY OF THE INVENTION

Pre-fabricated, modular housing units constructed of horizontally disposed, ten foot diameter, continuous culvert stock. Individual units are constructed at predetermined lengths and weights to facilitate the transportation thereof via truck, helicopter or other available transportation to remote sites. Multiple units may also be coupled to one another in an end-to-end fashion or in other configurations with the aid of transition units, to obtain additional living space.

In its preferred embodiment, the interior of each unit is constructed via conventional framing techniques by way of attaching a plurality of lengthwise channel members to the interior cylinder walls. Wooden nailing strips attached to the channel members thereafter permit the attaching of treated sheet goods thereto and which sheet goods serve as an attachment substrate for additional interior detailing.

Primary channel members are positioned at each quadrant and brace the center of the floor, walls and ceiling, whereas secondary angle-type channel members brace each corner. Rectilinear interior living space is thus achieved and which readily accommodates subsequent interior framing detail. Attendant electrical, plumbing and mechanical raceways and insulation space is also simultaneously achieved within the cavities formed between the interior room walls and curved cylinder walls.

Multiple units are coupled to one another via weatherproof band members which mount about the periphery of each cylindrical unit. Channel extension members provide continuity between the channels of each unit. Windows are mounted as desired via pre-formed, weatherproofed sleeves which extend through the exterior cylinder walls into the interior room walls. Conventional window sashes, in turn, mount in sealed relation to the sleeves.

Conventionally framed end walls are secured to the cylinder via collar members welded to the interior cylinder walls. Porch space may be obtained by recessing the end walls. Storage space is also available beneath the floor.

FIG. *7a* shows a detailed front view of a window sleeve.

FIG. *7b* shows a detailed cross section view of the window sleeve in mounting relation to the room and cylinder walls.

FIG. *8a* shows a lengthwise view of the relative positioning of the end walls and their flanged collars.

FIG. *8b* shows a view along reference lines *8b*—*8b* of FIG. *8a* of the front end wall, with the interior room walls in dotted line, relative to the flanged collar at the rear dead end wall.

DESCRIPTION OF THE PREFERRED EMBODIMENT

Figure 1:
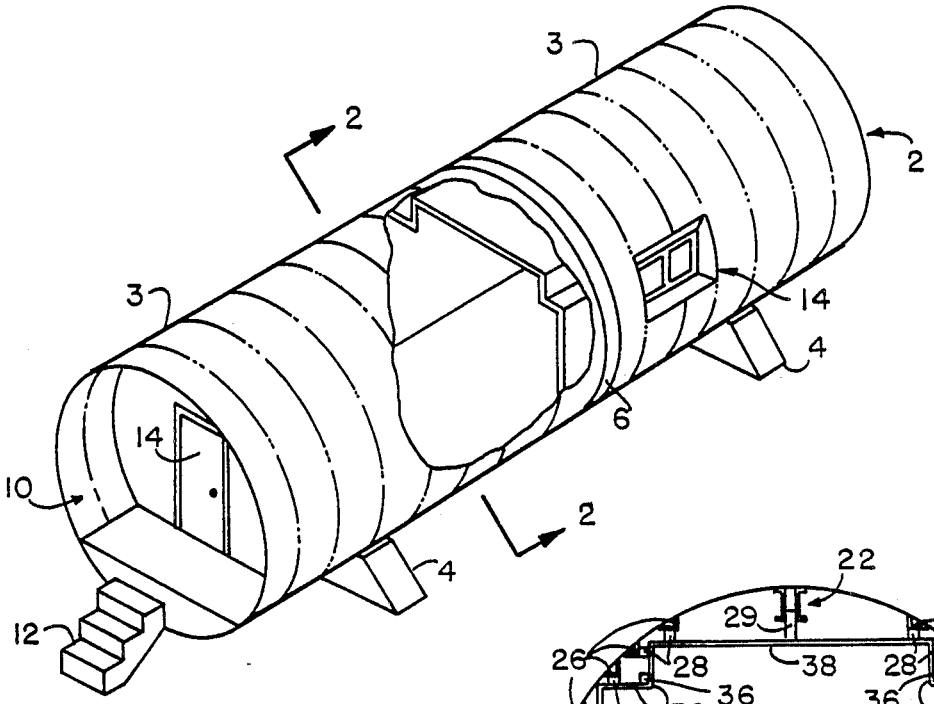
FIG. 1 shows a perspective view in partial cutaway of a multi-section dwelling constructed of the present modular housing units.

Turning attention to FIG. 1, a perspective view is shown of a multi-unit dwelling according to the present invention and wherein a portion of the interior is shown in partial cutaway. As depicted, the dwelling 2 rests on a pair of concrete supports 4 disposed along the bottom thereof. Depending upon the length of the unit, ground conditions and desired rigidity, additional supports 4 may be displaced along the bottom at closer spacings. Alternatively and for more remote areas, a variety of other types of supports may be used, or no supports at all, such as where the dwelling rests on the ground and/or where wedges are positioned on opposite sides along the length of the dwelling 2 to prevent it from rolling or otherwise shifting position with either use or weather conditions, such as wind.

The dwelling 2 of FIG. 1 is constructed of two modular units 3 which are coupled to one another at a weatherproof joint via a band coupler 6. As will be described in more detail hereinafter, splice members (not shown) are also added to improve the rigidity of the joint, to the point where a support 4 need not necessarily coincide therewith. While a two unit 3 dwelling 2 is shown, it is also to be appreciated that additional units 3 may be coupled to the dwelling 2 until a desired overall amount of living space is achieved.

Still further, should a T or L-type construction be desired, a junction box (not shown) may be coupled to the end of one of the units 3 and from which other units 3 may radiate. Alternatively, an open-arcuate ended side transition unit (not shown) may be coupled to the end of one unit 3 and a mid-portion of another unit 3, with the side wall being cut out at the intersection. Such transition members and/or junction boxes would however have to be sized to accommodate the ten-foot diameter culvert stock from which the present units would be constructed. It is also to be appreciated that while galvanized plated culvert stock is presently contemplated as being adequate for most environments, other coverings to either absorb or reflect the sun etc. might be sprayed over the exterior of each unit 3.

In this latter regard, it is to be further noted that the present modular units 3 are each constructed of continuous seamless lengths of ten foot diameter culvert stock and which at present are cut to lengths of approximately thirty-five feet, with a completed approximate weight for 16 gauge stock of 5,000 pounds and 7,000 pounds for 12 gauge stock. Such stock may however be fabricated in continuous lengths up to fifty feet, and thus one may construct individual dwelling units 3 of up to at least that length.

With the present construction methods however, it is felt that lengths of thirty-five feet are most acceptable and amenable to transportation via conventional railroad and trucking transportation, not to mention airlifting by helicopter or other anticipated ground transportation at the site. Such a length also equating with approximate fully constructed weights of 13,000 and 15,000 pounds respectively for the mentioned 16 and 12 gauge constructions. Alternatively, it is to be appreciated that the units 3 might be constructed in a seamed fashion using multiple curved plates which are bolted or otherwise attached to one another to produce a cylindrical shell. Due to the seams however, such construction is less desirable, in that it does not possess the same rigidity as the presently preferred construction, not to mention the necessity of requiring the sealing of each seam.

As presently constructed, the dwelling 2 also provides for a porch area 10 and leading to which are a short flight of pre-fabricated stairs 12. The front door 14 is thus set back slightly from the end of the leftmost unit 3. A window 14 is provided in the second unit 3 and a second door 14 (not shown) is provided in the rear bulkhead or end-wall.

From the cutaway portion of the dwelling 2, it is to be appreciated that the dwelling 2 is constructed with a conventional rectilinear interior framing and which facilitates later framing detail, such as the mounting of cabinets etc. As mentioned earlier, prior art constructions have opted for a more rudimentary construction (i.e. retaining the curved interior walls and using the ground as the floor) and which accordingly requires much more labor when subsequently fitting any necessary accoutrements. The details and advantages of the present framing will however become more apparent upon reference to the following figures.

Figure 2:
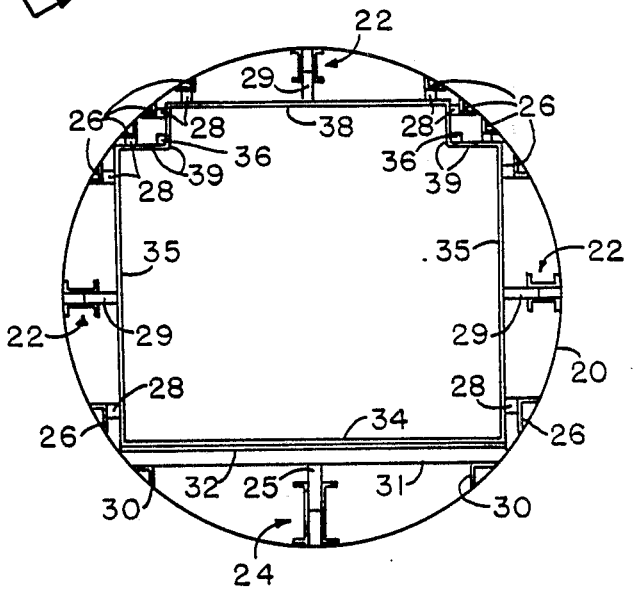
FIG. 2 shows a cross-section view taken along reference lines 2—2 of FIG. 1 of the framing detail used to obtain a rectilinear interior construction.

Accordingly and turning attention to FIG. 2, a cross section view taken along reference lines 2—2 of FIG. 1 is shown and wherefrom a detailed view is shown of the interior framing construction. In particular and weldably mounted about the interior periphery of the cylindrical walls 20 are a number of lengthwise channel members. Specifically and at each of the four interior quadrants are mounted individual primary channel members 22 and 24. That is, primary channel members 22 are provided at the center of the left and right-side walls and at the top center of the ceiling. A larger primary channel member 24, in turn, is provided at the bottom center of the floor. Mounted also at each corner of the interior walls are individual lengths of angle iron corner members 26 and to which are secured wooden nailer strips 28.

The corner channel members 26 are presently constructed of $2\frac{1}{2}$ inch by $1\frac{1}{2}$ inch by 3/16 inch angle iron stock. The primary channel members 22 are constructed of back-to-back lengths of 8.5 gauge, C-type channel stock at a typical width of eight inches. The primary channel member 24, in turn, is constructed of back-to-back 10.6 gauge, C-type channel stock at a twelve inch width. Each of C-shaped portions of the primary channel members 22 and 24 is spaced apart from its adjacent neighbor via appropriate two-by framing members 25 and 29 and which also act as nailer strips for the walls, ceilings and floors. For the primary members 22, a 2×6 inch nailing member 29 is used and for the primary member 24, a 2×12 inch nailing member 25 is used.

The floor is constructed by mounting a number of floor joists 31 over the nailing member 29 on sixteen inch centers. Each joist 31 extends horizontally across the interior of each unit 3 and is selected from either a 2×4 or a 2×6 inch stock and is angle cut at its right and left ends to accommodate the arch of the interior wall 20. Each joist member 31 is further supported at its ends via lengthwise extending angle members 30 which are mounted therebeneath and welded to the cylinder walls 20. Two layers 32 and 34 of ½ inch thick, pressure treated, rot resistant plywood are thereafter nailed or screwed to the joist members 31 with staggered seams to establish the interior floor.

The walls 35 are constructed by first securing corner channel members 26 with associated 2×2 inch nailers 28 to the culvert walls 20 adjacent the points of intersection of the floor with the cylinder walls 20. Mounted plumb then with the bottom corner channel members 26 and the 2×6 inch nailers 29 of the primary channel members 22 are the upper corner channel members 26 and their nailers 28. Single layer plywood wall sections are then secured to the nailers 28 and the left and right side center nailer members 29. At this point, it is to be noted that using a ten foot diameter culvert stock, a floor width of eight feet is thus achievable at the about to be described ceiling heights and which is believed sufficient for most uses, given the intended purpose.

Relative to the ceiling 38 and in order to accommodate a maximum ceiling height of seven feet, the walls are stepped inward, approximately one foot via cantilevered sections 39 and which provides the above maximum ceiling height at the ceiling section 38. In order to achieve this end and as apparent from FIG. 2, additional channel members 26 and nailer members 28 are provided at the intersection of the primary ceiling section 38 and the cantilevered sections 39 with the cylinder walls 20. The intersection of the cantilevered sections 39 with each other are, in turn, backed with 2×2 nailing members 36. Thereafter and like the walls 35, ½ inch plywood panels are secured to the nailers 28, 29 and 36 to form the ceiling sections 38 and 39.

The rough interior of each modular unit 3 is thus constructed of a plywood substrate which can withstand the contemplated extremes in temperature and humidity for the locales where such units 3 are intended. Should additional wall coverings be desired, they may be added as required to the substrates and which at the provided spacings are sufficient to permit attachment thereto either via screws, nails, staples, glue or the like. Where mechanical fasteners are used, it is contemplated that these may be affixed using pneumatic tools and which require less labor.

As should also be apparent from FIG. 2, given the framing of rectilinear walls, numerous cavities are created between the subfloor 32, walls 35 and ceiling 38 relative to the cylinder walls 20. Depending upon the intended use of the living units, these spaces readily accommodate raceways for all necessary electrical, plumbing and mechanical systems. For example, dehumidifier piping may occupy this space; hot air supply ducts; cold air returns; electrical wiring and plumbing runs; not to mention insulation for cold climates. For those installations of longer than one unit 3, it is further contemplated that appropriate junction boxes, compression or flared fittings etc. would be provided at the open end of each unit 3 so as to mate with any related runs mounted within the mating unit 3. On-site installation is thus minimized. Each system may also be more easily inspected at the factory to determine its operability, prior to shipping.

Figure 3:
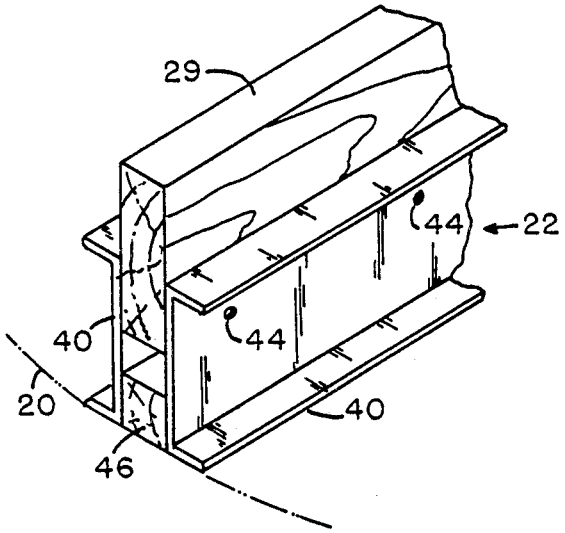
FIG. 3 shows a detailed perspective view of the primary lengthwise channel members.
Figure 4:
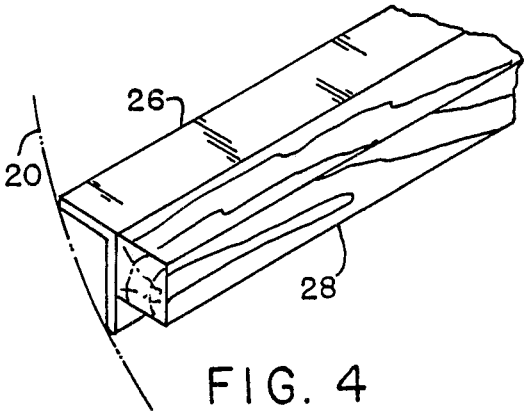
FIG. 4 shows a detailed perspective view of the angle-type secondary channel members.

Referring next to FIGS. 3 and 4, respective detailed perspective views are shown of one of the primary channel members 22 and corner channel members 26. With attention directed first to FIG. 3, a view is shown of one of the primary channel members 22 and which as mentioned is constructed of back-to-back lengths of 8.5 gauge, C-shaped stock. Each of the halves 40 are welded to the walls 20 via appropriate metal-inert gas MIG welders or other types of welders and may either be continuous welded or spot welded, depending upon the ultimate rigidity desired. That is, not only do the channel members 22, 24 and 26 secure the nailer members 29, 25 and 28 to the wall 20, they also act to stiffen the walls 20.

The nailer members 29 are, in turn, secured to the channel members halves 40 at appropriate spacings (e.g. 24 inches on center) via screw fasteners let through holes 44 provided along the length of the channel members 40. Each nailer member is thus secured on two sides between the halves 40.

Also shown in FIG. 3 is a spacer block 46, lying adjacent the culvert wall 20. During assembly, such spacers 46 are first clamped to the cylinder walls 20 at desired locations. The channel member halves 40 are then clamped to the spacers 46 and spot welded to maintain their position, the spacers 46 are then removed and the welds completed. An appropriate spacing is thereby achieved to accommodate the subsequently inserted nailers 29 over the entire length of each unit 3.

Directing attention next to FIG. 4, the angle channel members 26 are similarly MIG welded to the cylinder walls 20. Prior to welding though, the wood nailers 28 are first secured to the channel members 26 via mounting holes 44 and screw fasteners 42 (not shown). Also and because the welding process may cause some scorching of the wood nailer 28, a thin layer of fire retardant material (not shown) may be inserted between each nailer 28 and the channel member 26 to minimize the risk of fire.

Figure 5:
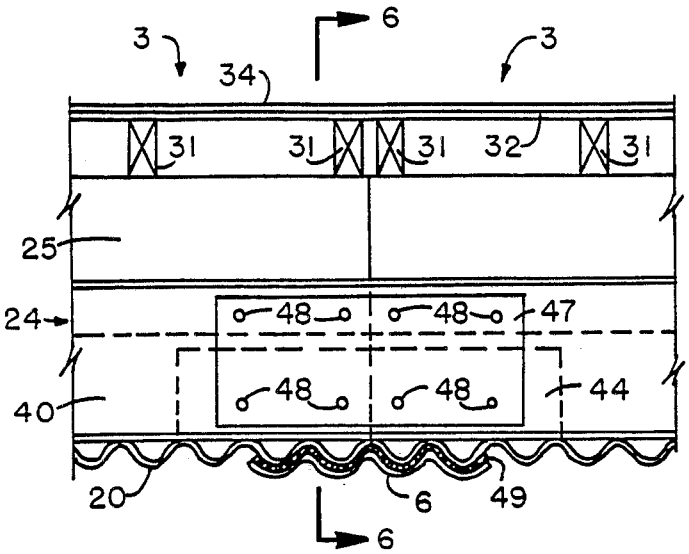
FIG. 5 shows a partial detailed view of the coupling detail for securing two units to one another.
Figure 6:
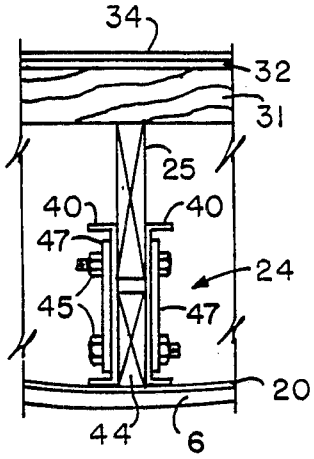
FIG. 6 shows an end view taken along reference lines 6—6 of FIG. 5 of the primary channel splice.
Figure 7A:
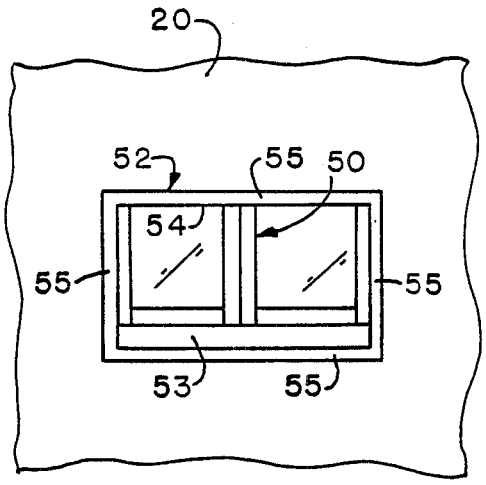
Figure 7B:
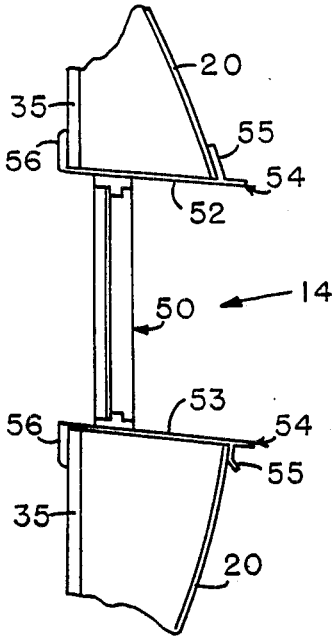
Figure 8B:
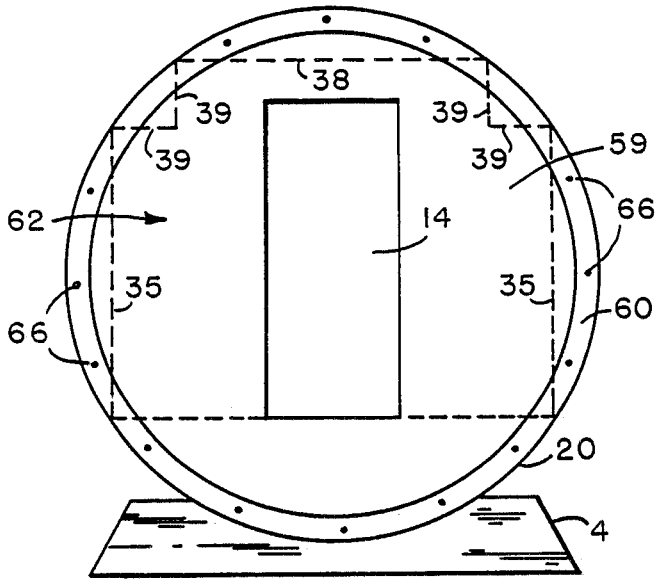
Figure 8A:
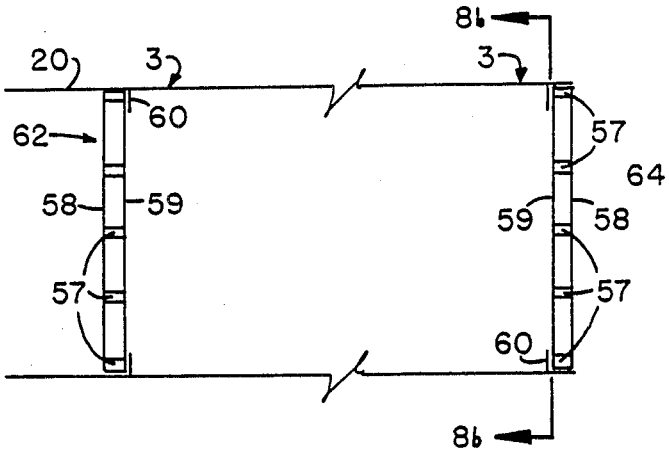

Referring next to FIGS. 5 and 6, respective views are shown of the splice members 47 used along with the band coupler 6 to couple two living units 3 to one another. In particular and with attention first directed to FIG. 5, a partial detailed cross-section view is shown of the splicing of the primary channel member 24 from one unit with that of another relative to the cylinder walls 20, band coupler 6 and flooring detail of the units 3. As depicted and depending upon whether or not the end of a unit 3 is intended for mounting to another unit 3, the end will be framed differently. Assuming however that a coupling is intended, the unit 3 is framed such that the channel members 22, 24 and 26 extend from the closed end wall to the opposite open end of the unit 3. For a unit with no end walls, the channel members extend the entire length of the unit 3. In any case though, prior to abutting two units 3 to one another, a spacer block 44 (shown in hidden line) is inserted within one of the primary channel members of one of the units to act as a registration guide for the mounting with the adjacent unit 2. Similarly, end spacer blocks 46 are inserted in the primary channel member 22.

Upon abutting the two units 3 to one another, a metal splice plate 47 having a plurality of mounting holes 48 drilled therethrough and mating with a corresponding hole pattern in each of the halves 40 of the abutting primary members 24 is positioned so as to overlap each of the abutting channel members 24. A second splice plate 47 is similarly positioned to overlap the opposite abutting halves 40 of the channel members 24 and after which through bolts are passed through both halves 40 of each channel member 24 and the splice plates 47 and drawn tight via lock washers and nut fasteners 45.

It is also to be appreciated that access is gained to the cavities for tightening the bolts/nuts 45 by not fully assembling the plywood sheeting for the floors, walls and ceilings. Thus, upon securing the two sections to one another and bolting the splice members 47 in place, the sheeting can be appropriately attached interiorly of each unit 3 to further overlap the joint and thereby obtain additional rigidity at the joint by expanding the fastening over a larger area, other than just at the splice members 47. Further, it is contemplated that at the floor sheeting 32 and 34, the plywood would typically be laid in a lapped fashion such that seams would not coincide with one another.

Once then each of the channel members 22 and 24 is spliced to its counterpart at the neighboring unit 3, the band coupler 6 is secured around the entire circumference of the mated units 3. Presently, the band coupler 6 is constructed of a corrugated material like that of the cylinder walls 20 and is approximately twelve inches wide so as to extend beyond the actual joint itself. Prior also to mounting the band 6, a compressible band member or mastic 49 is positioned over each side of the joint, such that upon drawing the ends of the coupler 6 to one another, the band 6 compresses the mastic 49 and creates a waterproof seal.

With attention also directed to FIG. 6, a view is shown of the splice of FIG. 5 as seen along reference lines 6—6. In particular, a better view is obtained thereby of the mounting relation of the splice plates 47 to the channel members and the bolt/nut fasteners 45 used to secure the splice plates 47 thereto.

Referring next to the window opening of FIG. 1, the detailed front view of the mounting sleeve of FIG. *7a* and the detailed cross-sectional view of FIG. *7b*, it is to be appreciated that like the interior wall framing, it is an object of the present invention to adopt the use of conventional window sashes, without the necessity of specialized framing. Accordingly, the windows 14 of the present units 3 are of conventional slide-by construction and double glazing. Screen members (not shown) may be added as desired in conventional fashion and as the sash 50 permits.

Each window sash 50 is mounted via a pre-assembled weatherproof sleeve 52 that mounts through the cylinder walls 20 and the interior plywood walls 35. The sleeve member 52 may be constructed of a number of different gauges of sheet stock but must be sufficiently rigid so that it will not flex during the opening and closing of the sash 50 and which might otherwise induce binding. Depending too upon the size of the sash 50, it is to be appreciated that some of the tendency to flex is reduced by securing the sleeve 52 to the unit 3.

That is, upon cutting holes through the walls 20 and 35, with the hole in the wall 35 being displaced somewhat higher or above the opening through the wall 20, the sleeve 52 is inserted and formed to the openings. The sleeve 52 is inserted from the exterior of the unit 3 to the point where the flanged drip edge 54 abuts against the walls 20. (A formed drip edge 54 being provided around the periphery of the sleeve 52 so as to extend slightly beyond and to the sides of the edges of the cut opening.) First though the portion 55 of the flange 54 which mates against the walls 20 is caulked with a sealant and which sealant, upon setting the sleeve 52 against the cylinder walls 20, is distributed over the back thereof. Thereafter, screw fasteners are mounted through provided holes to secure the sleeve 52 to the wall 20. With the curing of the sealant, any rain is thus prevented from penetrating the cut edges of the window opening and the formed portions 55 of the drip edge 54 direct water away from the window sash 50, thereby preventing the buildup of water at the bottom of the sleeve adjacent the sash 50. Tipping the sleeve 52 within the wall openings similarly produces an incline of the sill portion 53 to assure that any rain which might overflow the drip cap (i.e. the top horizontal portion of the drip edge 54) will be directed outwardly and away from the window area and also that any water blown against the sash 50, will similarly drain off.

The portion of the sleeve 52 extending into the interior of the structure is thereafter cut at each of its corners and bent over the plywood walls 35 and nailed or otherwise fastened thereto. Molding 56 is subsequently mounted thereover to hide the rough edges.

The framed sash 50 is, in turn, secured to the sleeve 52 by first mounting a gasket (not shown) around the outer periphery of its frame before inserting it into the sleeve 52. Upon being inserted to a desired depth, the sash frame is secured to the sleeve 52 by fasteners, such as screws, which are inserted through the sleeve walls into the sash frame. Most commonly therefore, the framed window sashes 50 are inserted into the sleeve 52, prior to fitting the sleeve 52 within the walls. Also and in a similar fashion, additional windows 14 are added as desired without undue difficulties.

Recalling further that the end walls of each unit are constructed in a conventional stud wall fashion and directing attention to FIGS. *8a* and *8b*, it is to be appreciated that each end wall contains a number of studs 57 which are positioned approximately sixteen inches on center and to the exterior and interior faces of which are secured treated plywood sheeting 58 and 59. The sheeting also overlaps the outermost studs so that it can be cut to a circular shape of a diameter slightly less than that of the cylinder stock. Each end wall may thus be slip fit into the interior of the cylinder. The depth of insertion of each end wall is determined by annular flanged collars 60 which are secured at the opposite ends of the living space 2.

Specifically, FIGS. *8a* and *8b* show respective front and side views of the mounting positions of these collars 60 relative to the front 62 and rear 64 end walls. The collars 60 themselves are weldably secured to the interior of the cylinder walls 20. Holes 66 are also provided through each collar 60 such that upon abutting the framed end walls 62 or 64 thereto, screw fasteners draw the end walls thereagainst. A bead of caulk or a gasket may thereafter be applied around the periphery of the end walls at the intersection with the cylinder walls 20 to seal the end walls 62 and 64 in weatherproof relation to the unit 2.

In lieu of an annular collar 60, it is also to be appreciated that a plurality of drilled angle members (not shown) might be weldably positioned about the interior of the cylinder walls 20, the primary goal being to obtain a rigid mounting of each end wall to the cylinder walls 20.

While the present invention has been described in some detail relative to its presently preferred embodiment, it is to be appreciated that numerous modifications may still be made thereto by those of skill in the art. It is accordingly contemplated that the following claims should be interpreted so as to include all those equivalent embodiments within the spirit and scope thereof.

What is claimed is:

1. A modular above ground shelter unit comprising:

(a) a cylindrical shell member having an environmentally protective exterior coating, wherein the interior of said shell member contains rectilinearly frame constructed living space, the floor, side walls and ceiling thereof being secured to a plurality of lengthwise channel members secured to the interior shell wall and including end walls secured to stop members mounted to the interior shell wall, and wherein lengthwise cavities formed between the interior shell wall and living space walls act as raceways for appurtenant, electrical, mechanical and plumbing systems; and (b) means for supporting said shell member in horizontal fixed relation to the ground surface.

2. A shelter as set forth in claim 1 including a plurality of pairs of lengthwise extending C-shaped channel members weldably mounted to the interior shell wall in back-to-back relation to one another and separated by a lengthwise wooden member secured therebetween.

3. A shelter as set forth in claim 2 including a plurality of lengthwise L-shaped channel members, each having a lengthwise wooden member secured thereto and to the interior framing adjacent the intersection of the corners of the interior framing with the interior shell wall.

4. A shelter as set forth in claim 1 including at least one window, wherein said window is mounted in weathertight relation to a rectilinear tubular sleeve mounted through the interior living space walls and the shell wall and wherein the sleeve is canted at its interiorly mounted end above its exteriorly mounted end.

5. A shelter as set forth in claim 4 wherein the exteriorly mounted end of said sleeve is formed to include an L-shaped flange around the periphery thereof, a first portion of the flange extending beyond the shell wall to channel water away therefrom and a second portion overlapping a mounting hole cut through the shell wall and wherein means are mounted relative to said second flange portion to seal said sleeve in weatherproof relation to said shelter.

6. A shelter as set forth in claim 1 wherein said end wall stop members comprise annular flanges concentrically, weldably secured to the interior shell wall and which include a plurality of spaced apart mounting holes, whereby fasteners secure the end walls thereto.

7. A shelter as set forth in claim 1 wherein said cylindrical shell member comprises at least two shorter abutting shell portions secured to one another in end-to-end relation and wherein ones of a plurality of splice members are each secured to said lengthwise channel members at the intersection of the shorter shell portions.

8. A shelter as set forth in claim 7 including:

(a) a draw-type band member circumferentially mounting in overlapping relation to each of the shorter shell portions at the intersection thereof; and (b) means for sealing the band member in weathertight relation to shell portions.

9. A shelter as set forth in claim 1 wherein said cylindrical shell member comprises a continuous length of ten foot diameter culvert pipe.

10. A shelter as set forth in claim 1 wherein a front door containing end wall of said shelter is recessed from an end of the shell member to form an entryway and including a floor therein substantially at the same level as the living space floor.

11. A shelter as set forth in claim 10 including a stairway transition between the ground and the entryway floor.

12. A modular above ground shelter unit comprising:

(a) a cylindrical shell member having an environmentally protective exterior coating, wherein the interior of said shell member contains rectilinearly frame constructed living space, the space being defined by a floor, side walls, ceiling and end walls and wherein lengthwise cavities formed between the interior shell wall and living space act as raceways for appurtenant, electrical, mechanical and plumbing systems;

(b) a plurality of pairs of lengthwise extending C-shaped channel members weldably mounted to the interior shell wall in back-to-back relation to one another and separated by a lengthwise wooden member secured therebetween and to one of said interior side walls, floor or ceiling;

(c) a plurality of lengthwise L-shaped channel members secured to the interior shell wall and each supporting a lengthwise wooden member adjacent the intersection of one of the corners of the interior framing with the interior shell wall;

(d) at least one window mounted in weathertight relation to a rectilinear tubular sleeve mounted through the interior living space walls and the shell member and wherein the sleeve is canted at its interiorly mounted end above its exteriorly mounted end; and (e) wall stop members concentrically, weldably secured to the interior shell wall and to one of said end walls.

* * * * *